US006834451B1

(12) United States Patent
Prost

(10) Patent No.: US 6,834,451 B1
(45) Date of Patent: Dec. 28, 2004

(54) PICTURE BALL

(75) Inventor: Christian Prost, Tsim Sha Tsui (HK)

(73) Assignee: Intermed Asie Company Limited, Tsim Sha Tsui (HK)

( * ) Notice: Subject to any disclaimer, the term of this patent is extended or adjusted under 35 U.S.C. 154(b) by 12 days.

(21) Appl. No.: 10/617,023

(22) Filed: Jul. 11, 2003

(51) Int. Cl.[7] ..... G09F 9/302
(52) U.S. Cl. ..... 40/446; 40/492; 273/153 S
(58) Field of Search ..... 40/446, 493, 492, 40/733, 779; 273/153 S, 153 R

(56) References Cited

U.S. PATENT DOCUMENTS 5,338,033 A * 8/1994 Nunez Serrano ..... 273/153 S
5,452,895 A * 9/1995 Ray ..... 273/153 S
5,566,941 A * 10/1996 Destics ..... 273/153 S
5,816,571 A * 10/1998 Chen ..... 273/153 S
5,836,584 A * 11/1998 Chen ..... 273/153 S

* cited by examiner

*Primary Examiner*—Gary C. Hoge

(57) ABSTRACT

A rotatable magic picture ball comprises a ball assembly comprising an upper section including four upper units and a lower section including four lower units wherein each unit occupies one eighth of a sphere and is rotatable, and each lower unit comprises a bottom cavity; a base assembly comprising four sectors each occupying about a quarter of a cylinder and a central recessed portion including two vertical sleeves and two horizontal sleeves, each sleeve having two channels for rotatably coupling the sectors together; eight half-circular stickers and two circular stickers adhered to inner surfaces of the units so that the units can turn each other; and an interior magnet on each upper unit so that two adjacent upper units can be magnetically secured together. A variety of shapes and colorful patterns for advertisement can be formed by the stickers having predetermined patterns and/or the ball assembly having a predetermined pattern.

9 Claims, 11 Drawing Sheets

PICTURE BALL

BACKGROUND OF THE INVENTION

1. Field of the Invention

The present invention relates to picture balls and more particularly to such a rotatable picture ball having a particular application in advertisement.

2. Description of Related Art

A conventional magic block is a cube consisting of a plurality of small cubic blocks. A single sticker can be adhered to surface of each cubic block. Alternatively, two stickers are adhered to surfaces of two adjacent cubic blocks or four stickers are adhered to surfaces of four adjacent cubic blocks forming a square. These cubic blocks can be turned to form any of a variety of shapes. Accordingly, a variety of patterns are formed by the stickers. Moreover, a colorful pattern used as advertisement can be formed if the stickers are color.

However, the prior block is typically a cube. That is why we often call it magic cube. As to other shapes (e.g., spheres, ovals, or the like) of the magic block, there is no such disclosure as far as the present inventor knows. Further, many problems can arise with respect to, for example, a magic ball. After considerable research and experiment, the magic ball of the present invention has been devised to provide a brand new field of the continuous improvement of magic block.

SUMMARY OF THE INVENTION

It is an object of the present invention to provide a rotatable magic picture ball, comprising a ball assembly comprising an upper section including four upper units each occupying one eighth of a sphere and a lower section including four lower units each occupying one eighth of a sphere wherein each lower unit comprises a bottom cavity having a section of a quarter of a circle and a plurality of top first posts, a vertical edge and two horizontal edges are formed in each upper unit, and a vertical edge and two horizontal edges are formed in each lower unit; a base assembly comprising four sectors each occupying about a quarter of a cylinder and a central recessed portion including two vertical sleeves each having two channels and two horizontal sleeves each having two channels wherein each sector comprises a plurality of top holes with the first posts firmly fitted therein for positioning the lower section on the base assembly, a first recess at an inner corner thereof, a second post having a length less than that of the channel on the first recess, two adjacent second posts being rotatably inserted into the channels of one vertical sleeve for securing a first sector to an adjacent second sector and other two adjacent second posts being rotatably inserted into the channels of the other vertical sleeve for securing a third sector to an adjacent fourth sector, and a second recess besides the first recess, the second recess including two spaced pegs on its sides, the pegs of the first sector being rotatably fitted into one channel of one horizontal sleeve, the pegs of the fourth sector being rotatably fitted into the other channel of one horizontal sleeve for securing the first and the fourth sectors together, the pegs of the second sector being rotatably fitted into one channel of the other horizontal sleeve, the pegs of the third sector being rotatably fitted into the other channel of the other horizontal sleeve for securing the second and the third sectors together, and one of the first posts being rotatably inserted into one of the channels of the vertical sleeves for securing one lower unit to the sector below it; a plurality of stickers comprising first and second half-circular stickers wherein the first half-circular sticker is adhered to a first inner surface of a first upper unit and that of a second upper unit together so that the first and the second upper units can be turned each other about the vertical edge therebetween, the second half-circular sticker is adhered to a first inner surface of a third upper unit and that of a fourth upper unit together so that the third and the fourth upper units can be turned each other about the vertical edge therebetween, third and fourth half-circular stickers wherein the third half-circular sticker is adhered to a first inner surface of a first lower unit and that of a second lower unit together so that the first and the second lower units can be turned each other about the vertical edge therebetween, and the fourth half-circular sticker is adhered to a first inner surface of a third lower unit and that of a fourth lower unit together so that the third and the fourth lower units can be turned each other about the vertical edge therebetween, fifth, sixth, seventh, and eighth half-circular stickers wherein each is adhered to a second inner surface of the upper unit and that of its below lower unit together so that each upper unit and its below lower unit can turn each other about one of the horizontal edges therebetween, and ninth and tenth circular stickers wherein the ninth circular sticker is adapted to adhere third inner surfaces of the first and the second upper units and third inner surfaces of the first and the second lower units together so that the first upper and lower units and the second upper and lower units can turn each other about the vertical edges therebetween, and the tenth circular sticker is adapted to adhere third inner surfaces of the third and the fourth upper units and the third inner surfaces of the third and the fourth lower units together so that the third upper and lower units and the fourth upper and lower units can turn each other about the vertical edges therebetween; and a magnet on the first inner surface of each upper unit so that two adjacent upper units can be magnetically secured together. By utilizing the present invention, a variety of shapes can be formed by rotation. Also, a variety of patterns including color ones for advertisement can be formed on the picture ball by the stickers having predetermined patterns and/or the ball assembly having a predetermined pattern on its surface. Moreover, the stickers can be printed on the inner surfaces of the units in advance rather than adhered thereto.

It is another object of the present invention to provide a rotatable magic picture ball, comprising a ball assembly comprising an upper section including four upper units each occupying one eighth of a sphere and a lower section including four lower units each occupying one eighth of a sphere wherein each lower unit comprises a bottom recess having two spaced pegs on its sides, and two horizontal sleeves each having two channels, the pegs of a first lower unit being rotatably fitted into one channel of one horizontal sleeve, the pegs of a fourth lower unit being rotatably fitted into the other channel of one horizontal sleeve so that the first and the fourth lower units can turn each other, the pegs of a second lower unit being rotatably fitted into one channel of the other horizontal sleeve, and the pegs of a third lower unit being rotatably fitted into the other channel of the other horizontal sleeve so that the second and the third lower units can turn each other, a vertical edge and two horizontal edges are formed in each upper unit, and a vertical edge and two horizontal edges are formed in each lower unit; a plurality of stickers comprising first and second half-circular stickers wherein the first half-circular sticker is adhered to a first inner surface of a first upper unit and that of a second upper unit together so that the first and the second upper units can be turned each other about the vertical edge therebetween, the second half-circular sticker is adhered to a first inner surface of a third upper unit and that of a fourth upper unit together so that the third and the fourth upper units can be turned each other about the vertical edge therebetween, third and fourth half-circular stickers wherein the third half-circular sticker is adhered to a first inner surface of a first lower unit and that of a second lower unit together so that the first and the second lower units can be turned each other about the vertical edge therebetween, and the fourth half-circular sticker is adhered to a first inner surface of a third lower unit and that of a fourth lower unit together so that the third and the fourth lower units can be turned each other about the vertical edge therebetween, fifth, sixth, seventh, and eighth half-circular stickers wherein each is adhered to a second inner surface of the upper unit and that of its below lower unit together so that each upper unit and its below lower unit can turn each other about one of the horizontal edges therebetween, and ninth and tenth circular stickers wherein the ninth circular sticker is adapted to adhere third inner surfaces of the first and the second upper units and third inner surfaces of the first and the second lower units together so that the first upper and lower units and the second upper and lower units can turn each other about the vertical edges therebetween, and the tenth circular sticker is adapted to adhere third inner surfaces of the third and the fourth upper units and the third inner surfaces of the third and the fourth lower units together so that the third upper and lower units and the fourth upper and lower units can turn each other about the vertical edges therebetween; and a magnet on the first inner surface of each upper unit so that two adjacent upper units can be magnetically secured together.

In one aspect of the present invention each sleeve has a substantially elongate elliptical section.

The above and other objects, features and advantages of the present invention will become apparent from the following detailed description taken with the accompanying drawings.

DETAILED DESCRIPTION OF THE PREFERRED EMBODIMENTS

Figure 1:
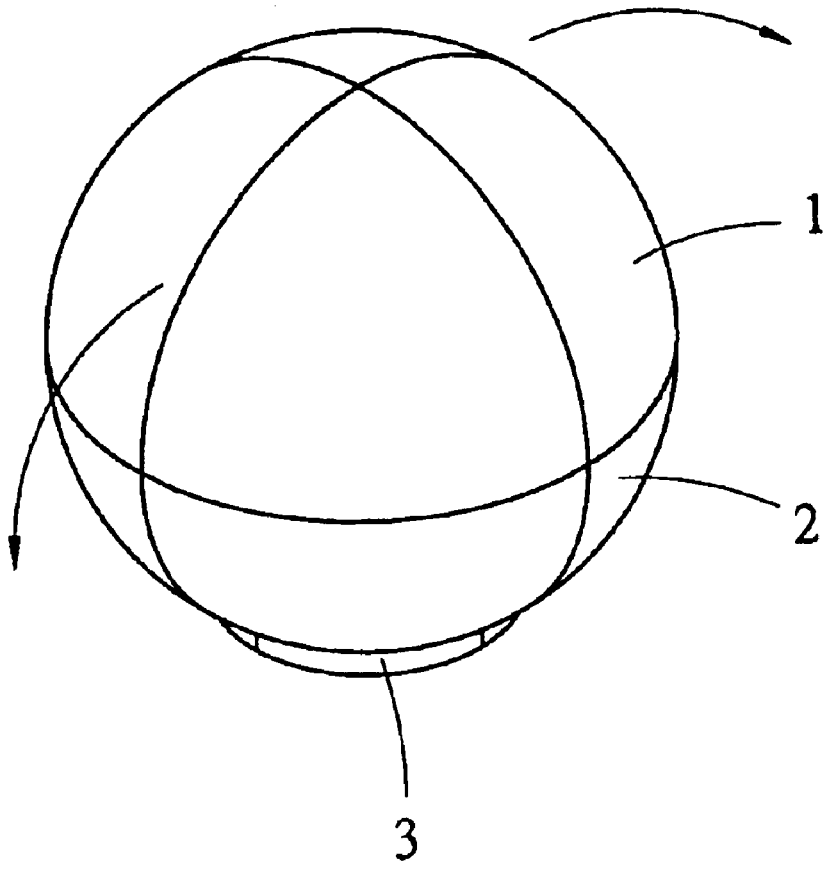
FIG. 1 is a perspective view of a first preferred embodiment of magic picture ball according to the invention.

Referring to FIG. 1, there is shown a magic picture ball constructed in accordance with a first preferred embodiment of the invention. The invention is described with respect to a magic ball, while it is appreciated by those skilled in the art that the ball may be replaced by an oval, ellipse, or the like in any of other embodiments without departing from the scope and spirit of the invention. The magic ball comprises a ball assembly including eight units each occupying one eighth of a sphere in which four units are upper units 1 and the remaining four units are lower units 2, and a base assembly 3 for anchoring the ball assembly and for providing a mechanism of turning the units 1 and 2.

Figure 2:
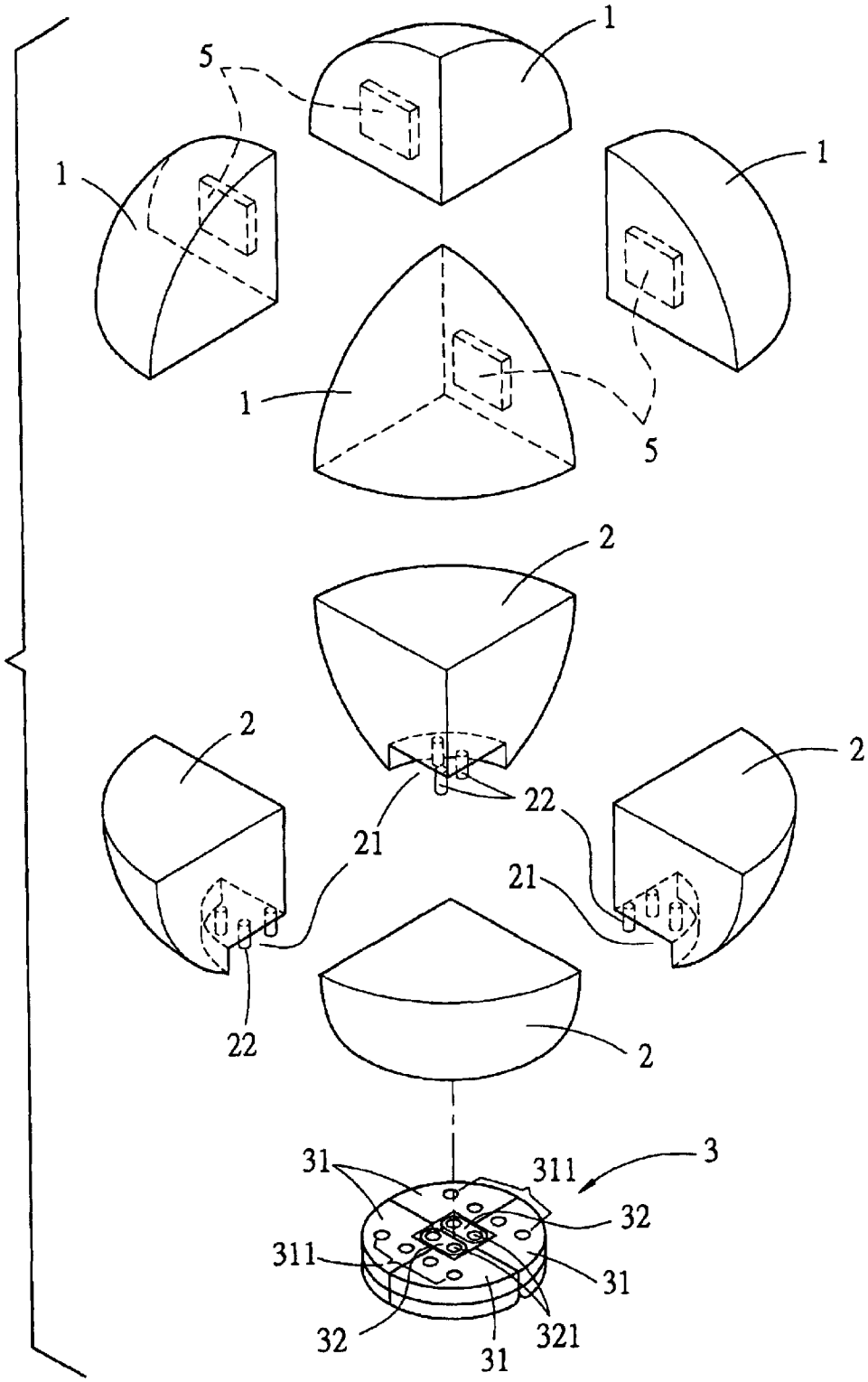
FIG. 2 is an exploded perspective view of the magic picture ball.
Figure 3:
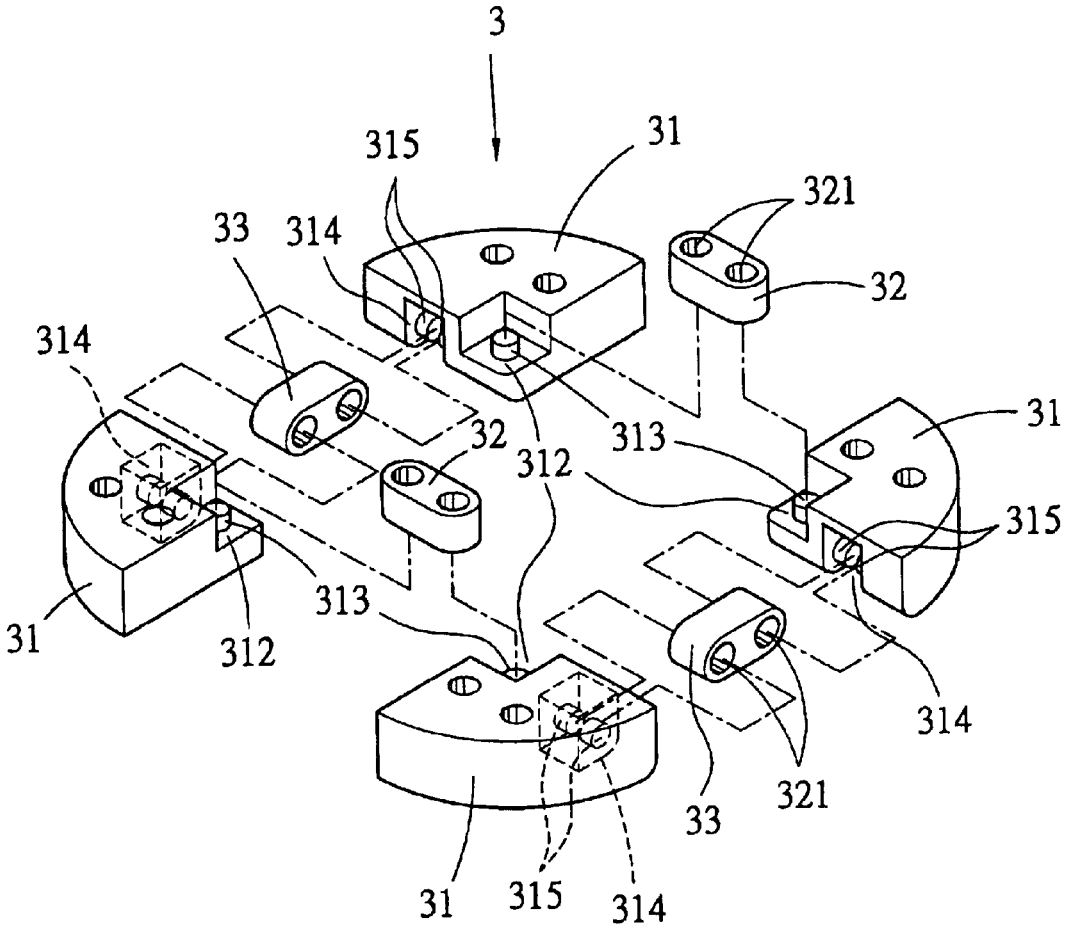
FIG. 3 is an exploded view of the base assembly.

Referring to FIGS. 2 and 3, a cavity 21 is formed in the bottom of each lower unit 2. A section of the cavity 21 is shaped as a quarter of a circle. A plurality of first posts (three are shown) 22 are formed on a top of the cavity 21. The base assembly 3 comprises four sectors 31 each occupying about a quarter of a cylinder (i.e., a quarter pie), and a central recessed portion for accommodating two vertical sleeves 32 each having a substantially elongate elliptical section and two channels 321. A plurality of holes 311 (two are shown) are formed on a top surface of each sector 31 for permitting two first posts 22 to firmly fit therein for positioning the lower units 2 on the base assembly 3.

As shown in FIG. 3, a first recess 312 is formed in the top corner of two perpendicular surfaces of each sector 31. A section of the first recess 312 is shaped as a quarter of a cube. A second post 313 having a length less than that of the channel 321 is formed on the first recess 312. Two second posts 313 are rotatably inserted into the channels 321 of one vertical sleeve 32 for securing a first one of the sectors 31 to an adjacent second one of the sectors 31. Similarly, other two second posts 313 are rotatably inserted into the channels 321 of the other vertical sleeve 32 for securing a third one of the sectors 31 to an adjacent fourth one of the sectors 31. A second recess 314 is formed besides the first recess 312. Two spaced pegs 315 are formed on sides of the second recess 314. The base assembly 3 further comprises two horizontal sleeves 33 each having a substantially elongate elliptical section and two channels 321. The pegs 315 of the first one of the sectors 31 are rotatably fitted into one channel 321 of one horizontal sleeve 33 and the pegs 315 of the fourth one of the sectors 31 are rotatably fitted into the other channel 321 of one horizontal sleeve 33 for securing the first and the fourth sectors 31 together. Similarly, the pegs 315 of the second one of the sectors 31 are rotatably fitted into one channel 321 of the other horizontal sleeve 33 and the pegs 315 of the third one of the sectors 31 are rotatably fitted into the other channel 321 of the other horizontal sleeve 33 for securing the second and the third sectors 31 together. As a result, all components of the base assembly 3 are secured together. Further, a third one of the first posts 22 is rotatably inserted into one channel 321 of the vertical sleeve 32 for securing one lower unit 2 to the sector 31 below it. In such a manner, four lower units 2 are completely secured to the sectors 31, i.e., the lower units 2 and the base assembly 3 are secured together.

Figure 4:
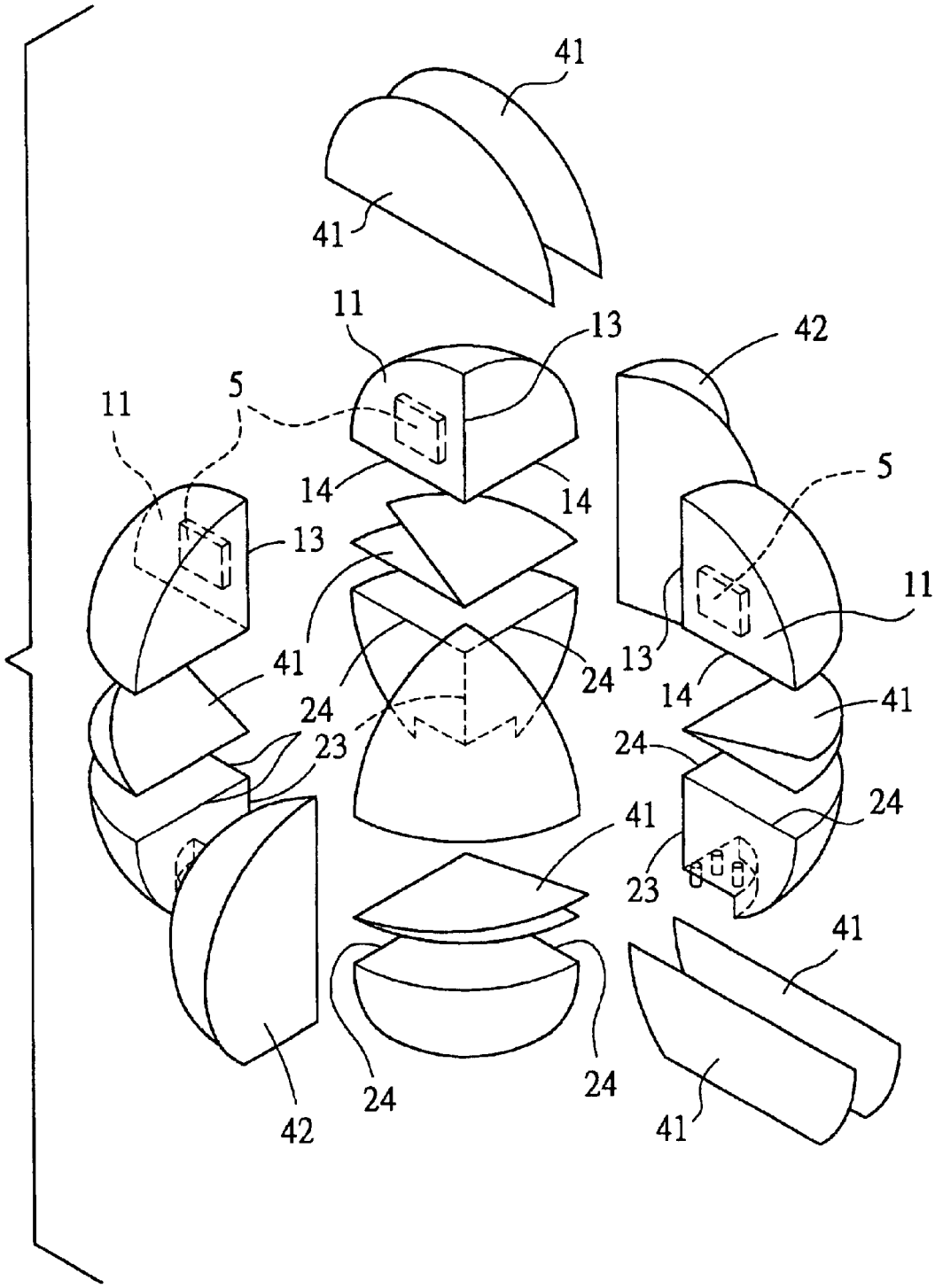
FIG. 4 is an exploded view of the ball assembly for depicting stickers adhered to surfaces of units of the ball assembly.
Figure 5:
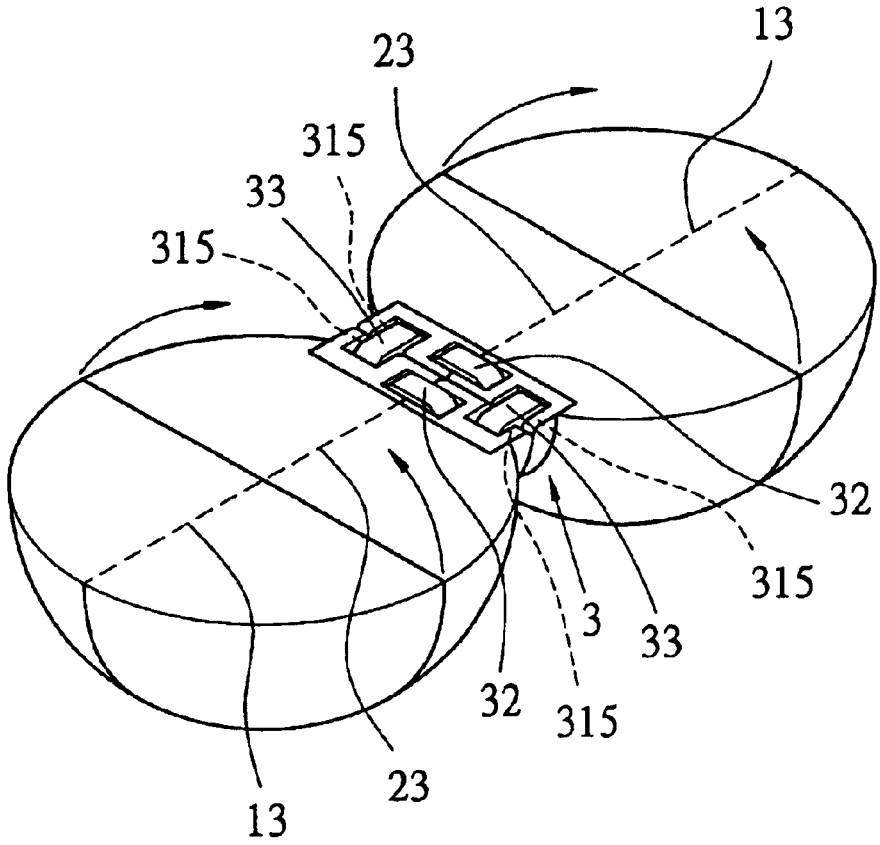
FIG. 5 is a perspective depicting a first shape of the magic picture ball after turning of its units.

Referring to FIG. 4, a vertical edge 13 and two horizontal edges 14 are formed in each upper unit 1 and a vertical edge 23 and two horizontal edges 24 are formed in each lower unit 2 respectively. Two half-circular stickers 41 are provided in which a first half-circular sticker 41 is adhered to one inner surface of the first one of the upper units 1 and that of the second one of the upper units 1 together so that the first one and the second one of the upper units 1 can be turned each other about the vertical edge 13 therebetween, and a second half-circular sticker 41 is adhered to one inner surface of the third one of the upper units 1 and that of the fourth one of the upper units 1 together so that the third one and the fourth one of the upper units 1 can be turned each other about the vertical edge 13 therebetween. Additional two half-circular stickers 41 are provided in which a third half-circular sticker 41 is adhered to one inner surface of the first one of the lower units 2 and that of the second one of the lower units 2 together so that the first one and the second one of the lower units 2 can be turned each other about the vertical edge 23 therebetween, and a fourth half-circular sticker 41 is adhered to one inner surface of the third one of the lower units 2 and that of the fourth one of the lower units 2 together so that the third one and the fourth one of the lower units 2 can be turned each other about the vertical edge 23 therebetween. Additional four half-circular stickers 41 are provided in which each is adhered to another inner surface of the upper unit 1 and that of its below lower unit 2 together so that each upper unit 1 and its below lower unit 2 are able to turn each other about one horizontal edge 14 or 24. Additional two circular stickers 42 are provided in which one circular sticker 42 is adapted to adhere further inner surfaces of the first and the second upper units 1 and further inner surfaces of the first and the second lower units 2 together so that the first upper and lower units 1 and 2 and the second upper and lower units 1 and 2 are able to turn each other about one vertical edges 13 and 23, and the other circular sticker 42 is adapted to adhere further inner surfaces of the third and the fourth upper units 1 and further inner surfaces of the third and the fourth lower units 2 together so that the third upper and lower units 1 and 2 and the fourth upper and lower units 1 and 2 are able to turn each other about the other vertical edges 13 and 23. Moreover, a magnet 5 is formed on one inner surface 11 of each upper unit 1 so that two adjacent upper units 1 can be magnetically secured together. As an end, all components of the magic ball are secured together. Referring to FIG. 5, a shape is formed after rotating one half of the picture ball with respect to the other half about the pegs 315 in a direction as indicated by arrows in FIG. 1. Further, the vertical sleeves 32 are disposed horizontally.

Figure 6:
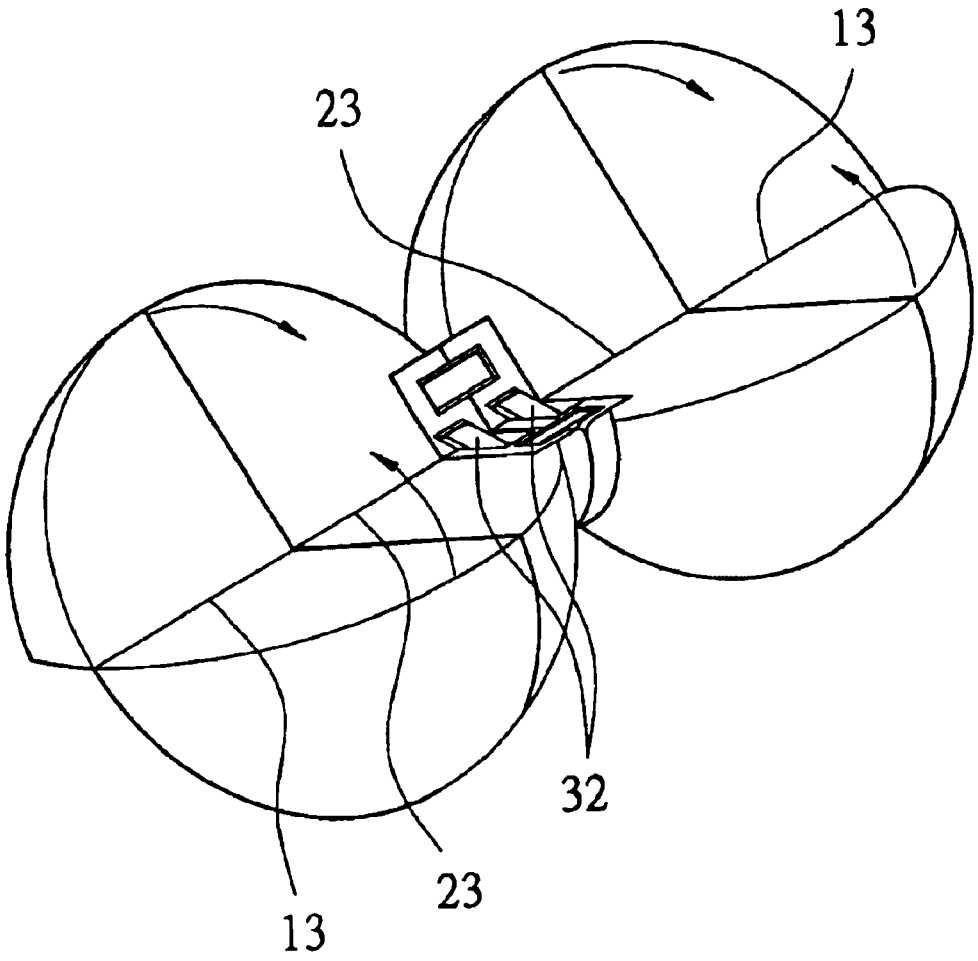
FIG. 6 is a perspective depicting a second shape of the magic picture ball after another turning of the units.

Referring to FIG. 6, another shape is formed after rotating one half of the picture ball with respect to the other half about the vertical edges 13 and 23 in a direction as indicated by arrows in FIG. 5.

Figure 7:
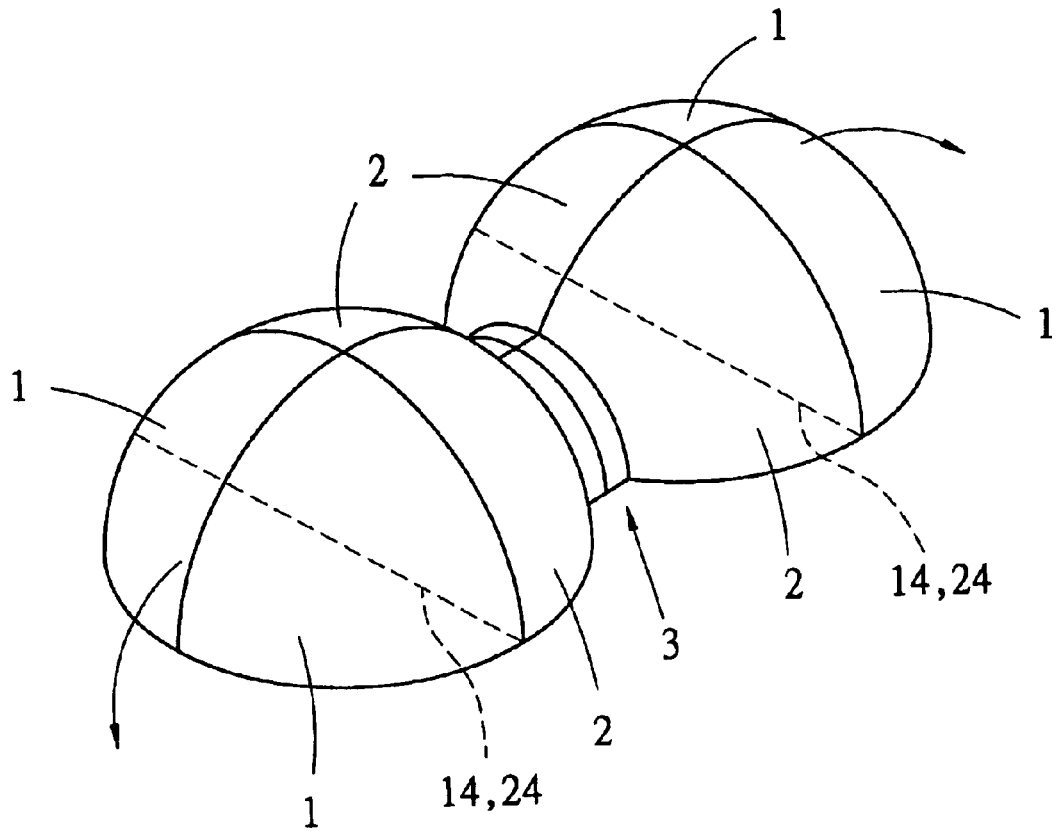
FIG. 7 is a perspective depicting a third shape of the magic picture ball after still another turning of the units.

Referring to FIG. 7, still another shape is formed after rotating one half of the picture ball with respect to the other half about the vertical edges 13 and 23 in a direction as indicated by arrows in FIG. 6.

Figure 8:
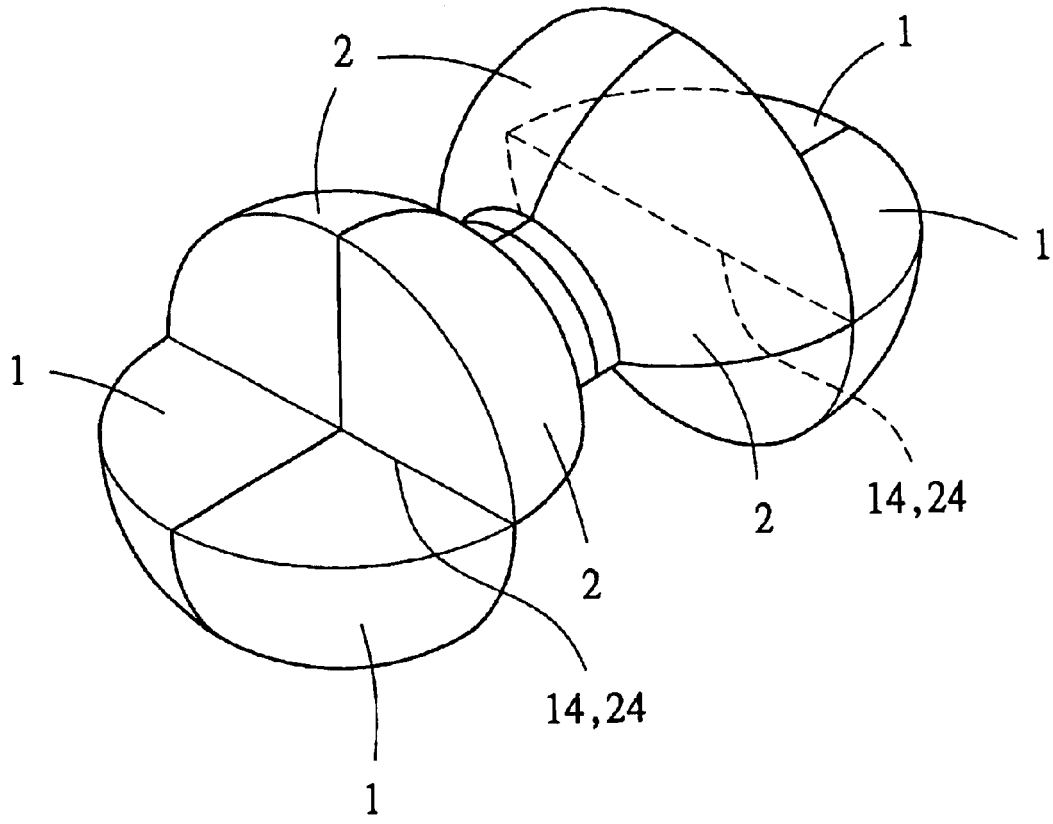
FIG. 8 is a perspective depicting a fourth shape of the magic picture ball after a further turning of the units.

Referring to FIG. 8, a further shape is formed after rotating one half of the picture ball with respect to the other half about the horizontal edges 14 and 24 in a direction as indicated by arrows in FIG. 7.

Figure 9:
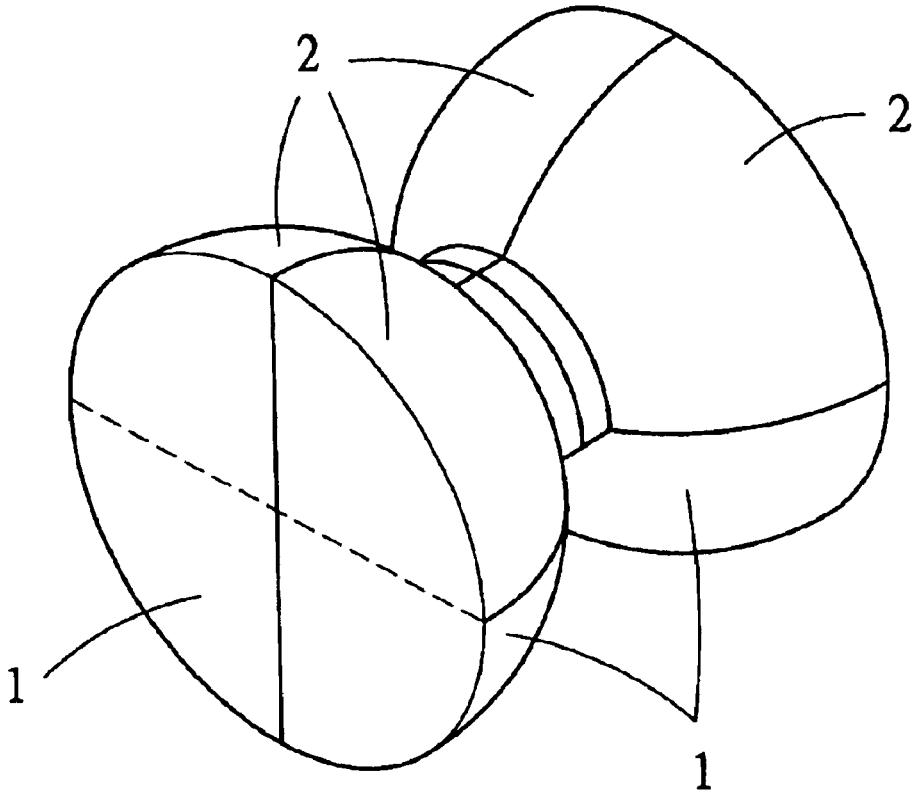
FIG. 9 is a perspective depicting a fifth shape of the magic picture ball after still further turning of the units.

Referring to FIG. 9, still further shape is formed after rotating one half of the picture ball with respect to the other half about the horizontal edges 14 and 24 in a direction as indicated by arrows in FIG. 8.

Figure 10:
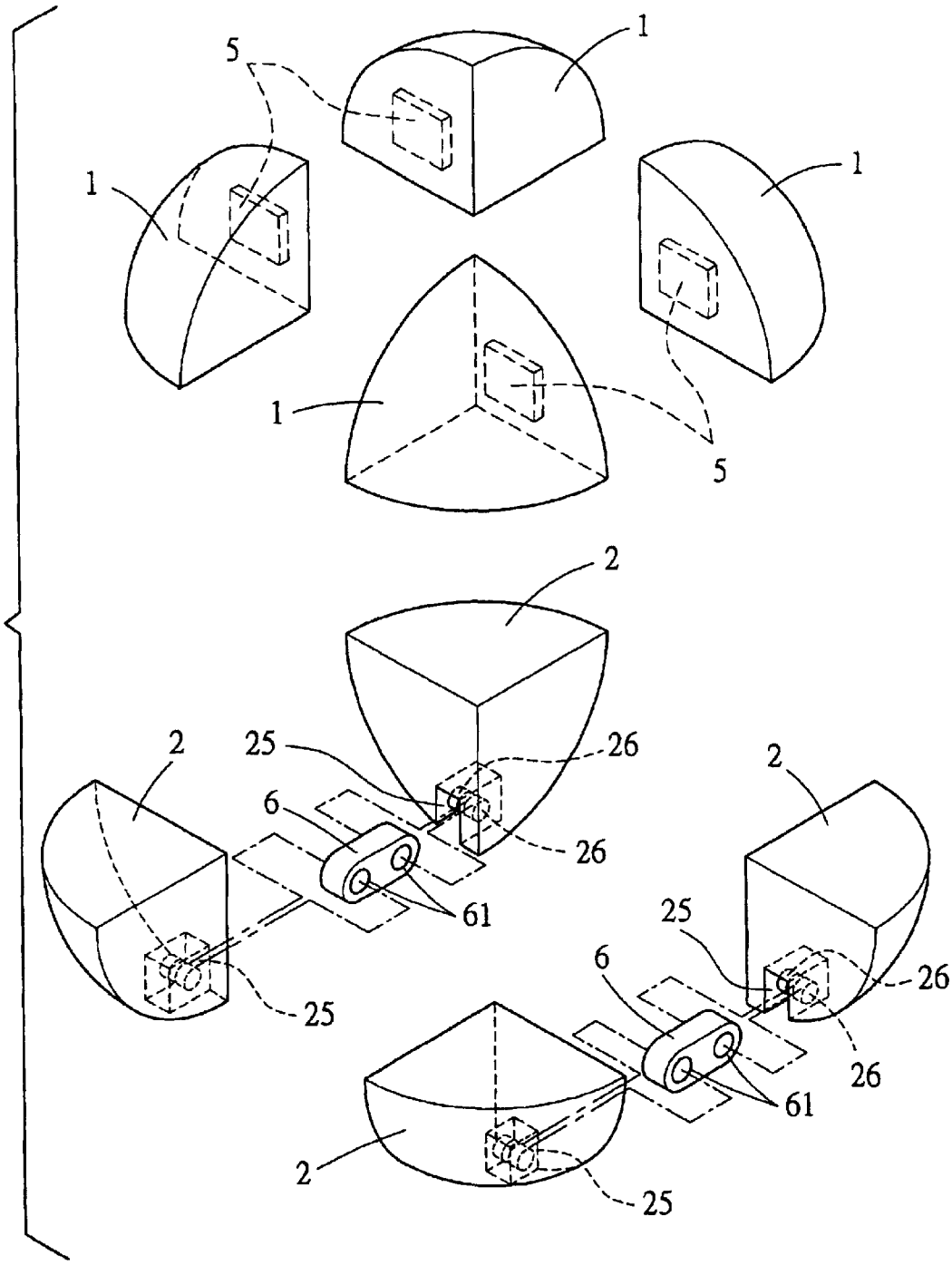
FIG. 10 is a perspective view of a second preferred embodiment of magic picture ball according to the invention.

Referring to FIG. 10, there is shown a magic picture ball constructed in accordance with a second preferred embodiment of the invention. The differences between the first and the second preferred embodiments, i.e., the characteristics of the second preferred embodiment are detailed below. The second preferred embodiment does not have a base assembly 3. Also, lower units 2 of its ball assembly are constructed differently from that of the first preferred embodiment. A recess 25 is formed in the bottom of each lower unit 2. Two spaced pegs 26 are formed on sides of the recess 25. Two horizontal sleeves 6 are provided each having a substantially elongate elliptical section and two channels 61. The pegs 26 of the first one of the lower units 2 are rotatably fitted into one channel 61 of one horizontal sleeve 6 and the pegs 26 of the fourth one of the lower units 2 are rotatably fitted into the other channel 61 of one horizontal sleeve 6 so that the first one and the fourth one of the lower units 2 can turn each other. Likewise, the pegs 26 of the second one of the lower units 2 are rotatably fitted into one channel 61 of the other horizontal sleeve 6 and the pegs 26 of the third one of the lower units 2 are rotatably fitted into the other channel 61 of the other horizontal sleeve 6 so that the second one and the third one of the lower units 2 can turn each other.

Figure 11:
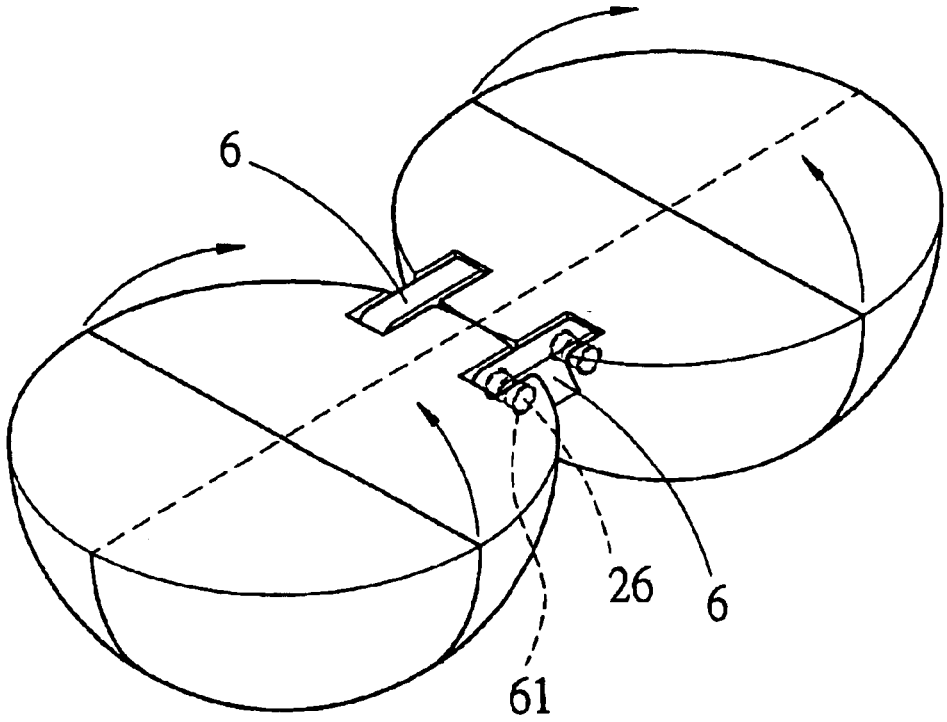
FIG. 11 is a perspective depicting a first shape of the FIG. 10 magic picture ball after turning of the units.

Referring to FIG. 11, a shape is formed after rotating one half of the FIG. 10 magic picture ball with respect to the other half about the pegs 26 in a direction as indicated by arrows in FIG. 1.

In brief, a variety of shapes can be formed by the picture ball. Also, a variety of patterns (including color ones) for advertisement can be formed on the magic ball by the stickers having predetermined patterns and/or the ball assembly having a predetermined pattern on its surface. Alternatively, the stickers can be printed on the inner surfaces of the units in advance rather than adhered thereto.

While the invention herein disclosed has been described by means of specific embodiments, numerous modifications and variations could be made thereto by those skilled in the art without departing from the scope and spirit of the invention set forth in the claims.

What is claimed is:

1. A rotatable picture ball, comprising:

a ball assembly comprising an upper section including four upper units each occupying one eighth of a sphere and a lower section including four lower units each occupying one eighth of a sphere wherein each lower unit comprises a bottom cavity having a section of a quarter of a circle and a plurality of top first posts, a vertical edge and two horizontal edges are formed in each upper unit, and a vertical edge and two horizontal edges are formed in each lower unit;

a base assembly comprising four sectors each occupying about a quarter of a cylinder and a central recessed portion including two vertical sleeves each having two channels and two horizontal sleeves each having two channels wherein each sector comprises a plurality of top holes with the first posts firmly fitted therein for positioning the lower section on the base assembly, a first recess at an inner corner thereof, a second post having a length less than that of the channel on the first recess, two adjacent second posts being rotatably inserted into the channels of one vertical sleeve for securing a first sector to an adjacent second sector and other two adjacent second posts being rotatably inserted into the channels of the other vertical sleeve for securing a third sector to an adjacent fourth sector, and a second recess besides the first recess, the second recess including two spaced pegs on its sides, the pegs of the first sector being rotatably fitted into one channel of one horizontal sleeve, the pegs of the fourth sector being rotatably fitted into the other channel of one horizontal sleeve for securing the first and the fourth sectors together, the pegs of the second sector being rotatably fitted into one channel of the other horizontal sleeve, the pegs of the third sector being rotatably fitted into the other channel of the other horizontal sleeve for securing the second and the third sectors together, and one of the first posts being rotatably inserted into one of the channels of the vertical sleeves for securing one lower unit to the sector below it; and a plurality of stickers comprising first and second half-circular stickers wherein the first half-circular sticker is adhered to a first inner surface of a first upper unit and that of a second upper unit together so that the first and the second upper units can be turned each other about the vertical edge therebetween, the second half-circular sticker is adhered to a first inner surface of a third upper unit and that of a fourth upper unit together so that the third and the fourth upper units can be turned each other about the vertical edge therebetween, third and fourth half-circular stickers wherein the third half-circular sticker is adhered to a first inner surface of a first lower unit and that of a second lower unit together so that the first and the second lower units can be turned each other about the vertical edge therebetween, and the fourth half-circular sticker is adhered to a first inner surface of a third lower unit and that of a fourth lower unit together so that the third and the fourth lower units can be turned each other about the vertical edge therebetween, fifth, sixth, seventh, and eighth half-circular stickers wherein each is adhered to a second inner surface of the upper unit and that of its below lower unit together so that each upper unit and its below lower unit can turn each other about one of the horizontal edges therebetween, and ninth and tenth circular stickers wherein the ninth circular sticker is adapted to adhere third inner surfaces of the first and the second upper units and third inner surfaces of the first and the second lower units together so that the first upper and lower units and the second upper and lower units can turn each other about the vertical edges therebetween, and the tenth circular sticker is adapted to adhere third inner surfaces of the third and the fourth upper units and the third inner surfaces of the third and the fourth lower units together so that the third upper and lower units and the fourth upper and lower units can turn each other about the vertical edges therebetween.

2. The picture ball of claim 1, wherein each of the vertical and the horizontal sleeves has a substantially elongate elliptical section.

3. The picture ball of claim 1, wherein the first recess has a section of a quarter of a cube.

4. The picture ball of claim 1, wherein the number of the first posts is three.

5. The picture ball of claim 1, further comprising a magnet on the first inner surface of each upper unit.

6. The picture ball of claim 1, wherein the number of the top holes of each sector is two.

7. A rotatable picture ball, comprising:

a ball assembly comprising an upper section including four upper units each occupying one eighth of a sphere and a lower section including four lower units each occupying one eighth of a sphere wherein each lower unit comprises a bottom recess having two spaced pegs on its sides, and two horizontal sleeves each having two channels, the pegs of a first lower unit being rotatably fitted into one channel of one horizontal sleeve, the pegs of a fourth lower unit being rotatably fitted into the other channel of one horizontal sleeve so that the first and the fourth lower units can turn each other, the pegs of a second lower unit being rotatably fitted into one channel of the other horizontal sleeve, and the pegs of a third lower unit being rotatably fitted into the other channel of the other horizontal sleeve so that the second and the third lower units can turn each other, a vertical edge and two horizontal edges are formed in each upper unit, and a vertical edge and two horizontal edges are formed in each lower unit; and a plurality of stickers comprising first and second half-circular stickers wherein the first half-circular sticker is adhered to a first inner surface of a first upper unit and that of a second upper unit together so that the first and the second upper units can be turned each other about the vertical edge therebetween, the second half-circular sticker is adhered to a first inner surface of a third upper unit and that of a fourth upper unit together so that the third and the fourth upper units can be turned each other about the vertical edge therebetween, third and fourth half-circular stickers wherein the third half-circular sticker is adhered to a first inner surface of a first lower unit and that of a second lower unit together so that the first and the second lower units can be turned each other about the vertical edge therebetween, and the fourth half-circular sticker is adhered to a first inner surface of a third lower unit and that of a fourth lower unit together so that the third and the fourth lower units can be turned each other about the vertical edge therebetween, fifth, sixth, seventh, and eighth half-circular stickers wherein each is adhered to a second inner surface of the upper unit and that of its below lower unit together so that each upper unit and its below lower unit can turn each other about one of the horizontal edges therebetween, and ninth and tenth circular stickers wherein the ninth circular sticker is adapted to adhere third inner surfaces of the first and the second upper units and third inner surfaces of the first and the second lower units together so that the first upper and lower units and the second upper and lower units can turn each other about the vertical edges therebetween, and the tenth circular sticker is adapted to adhere third inner surfaces of the third and the fourth upper units and the third inner surfaces of the third and the fourth lower units together so that the third upper and lower units and the fourth upper and lower units can turn each other about the vertical edges therebetween.

8. The picture ball of claim 7, wherein each of the horizontal sleeves has a substantially elongate elliptical section.

9. The picture ball of claim 7, further comprising a magnet on the first inner surface of each upper unit.

* * * * *